US008800715B2

(12) United States Patent
Olson et al.

(10) Patent No.: US 8,800,715 B2
(45) Date of Patent: Aug. 12, 2014

(54) RETRACTABLE FALL ARREST WITH COMPONENT ASSEMBLY AND CANTILEVERED MAIN SHAFT

(75) Inventors: Wayne L. Olson, Central Point, OR (US); Gary E. Choate, Lakewood, CO (US)

(73) Assignee: Reliance Industries, LLC, Wheat Ridge, CO (US)

( * ) Notice: Subject to any disclaimer, the term of this patent is extended or adjusted under 35 U.S.C. 154(b) by 8 days.

(21) Appl. No.: 13/299,317

(22) Filed: Nov. 17, 2011

(65) Prior Publication Data

US 2012/0118670 A1 May 17, 2012

Related U.S. Application Data

(60) Provisional application No. 61/458,107, filed on Nov. 17, 2010.

(51) Int. Cl.
*A62B 1/00* (2006.01)

(52) U.S. Cl.
USPC ..... 182/73; 182/237; 182/239; 182/231

(58) Field of Classification Search
USPC ..... 182/231–234, 73, 236–239, 3, 74, 75, 182/241; 254/267, 376, 375; 242/381.5, 242/381; 188/180, 188
See application file for complete search history.

(56) References Cited

U.S. PATENT DOCUMENTS 342,108 A * 5/1886 Kimball ..... 182/237
755,833 A * 3/1904 Appelman ..... 182/233
1,037,333 A * 9/1912 Scheuer ..... 182/239
2,544,729 A * 3/1951 Schauer ..... 182/239
2,998,148 A * 8/1961 Himel, Jr. ..... 414/139.5
3,760,910 A * 9/1973 Koshihara ..... 188/180
3,879,016 A * 4/1975 Kankkunen ..... 242/396
3,946,989 A * 3/1976 Tsuda ..... 182/241
4,018,423 A * 4/1977 Belew ..... 182/238
4,088,201 A * 5/1978 MacFarlane ..... 182/5
4,275,803 A * 6/1981 Putney ..... 188/134
4,437,546 A * 3/1984 Marinoff et al. ..... 182/233
4,463,933 A * 8/1984 Schreyer et al. ..... 254/368
4,511,123 A 4/1985 Ostrobrod
4,589,523 A 5/1986 Olson et al.
4,722,422 A * 2/1988 Hiraoka ..... 182/233
4,867,276 A * 9/1989 Tamietti ..... 182/233
4,877,110 A 10/1989 Wolner (Continued)

OTHER PUBLICATIONS

International Search Report and Written Opinion from corresponding International Application No. PCT/US2011/061281, mailed Aug. 1, 2012.

*Primary Examiner* — Daniel Cahn
(74) *Attorney, Agent, or Firm* — Polster, Lieder, Woodruff & Lucchesi, L.C.

(57) ABSTRACT

A retractable fall arrest device comprises a unit housing, a spring sub-assembly, a brake/clutch sub-assembly, and a drum assembly. The spring and brake/clutch sub-assemblies each include shaft portions which extend into the housing and are removably connected together or to the drum assembly, and support the drum assembly in the housing. The spring and brake/clutch assembly are themselves removably connected to the unit housing. Finally, the unit housing comprises two wall members (i.e., clam shells) which are removably connected together. This fall arrest device allows for replacement of any of the four constituent components of the device in the field, thus reducing the down time between repairs or recertification of a particular fall arrest device.

17 Claims, 9 Drawing Sheets

(56) References Cited

U.S. PATENT DOCUMENTS

| | | | | | |
|---|---|---|---|---|---|
| 4,941,549 | A | * | 7/1990 | Da-Tan et al. | 182/234 |
| 5,094,405 | A | * | 3/1992 | Brum | 244/1 TD |
| 5,186,289 | A | * | 2/1993 | Wolner et al. | 188/180 |
| 5,217,084 | A | * | 6/1993 | Olson et al. | 182/234 |
| 5,343,976 | A | * | 9/1994 | Ostrobrod | 182/4 |
| 5,351,906 | A | * | 10/1994 | Feathers | 242/396.6 |
| 5,738,339 | A | * | 4/1998 | Kuryu | 254/267 |
| 6,446,936 | B1 | * | 9/2002 | Ostrobrod | 254/368 |
| 7,281,620 | B2 | * | 10/2007 | Wolner et al. | 192/223.1 |
| 7,780,146 | B2 | * | 8/2010 | Casebolt et al. | 254/346 |
| 7,857,099 | B2 | * | 12/2010 | Choate | 182/234 |
| 2002/0155929 | A1 | * | 10/2002 | Lull et al. | 482/57 |
| 2003/0136610 | A1 | * | 7/2003 | Sato | 182/238 |
| 2009/0223744 | A1 | * | 9/2009 | Dowie | 182/234 |
| 2010/0116922 | A1 | | 5/2010 | Choate et al. | |

* cited by examiner

RETRACTABLE FALL ARREST WITH COMPONENT ASSEMBLY AND CANTILEVERED MAIN SHAFT

CROSS-REFERENCE TO RELATED APPLICATIONS

This application claims priority to U.S. Prov. App. No. 61/458,107 filed Nov. 17, 2010, which is incorporated herein by reference.

STATEMENT REGARDING FEDERALLY SPONSORED RESEARCH OR DEVELOPMENT

Not Applicable.

BACKGROUND OF THE INVENTION

This application relates to fall arrest units, and, in particular to a fall arrest unit comprised of easily assemblable components.

Retractable fall arrests or lifelines have been used for many years and range in size from small (6 ft) units to large (175 ft) units. The purpose of a retractable lifeline or fall arrest unit is to allow workers, who must work on the leading edge of elevated surfaces (or other areas were falls are of concern) to have a means to attach to an overhead anchorage that will arrest their motion in case of an accidental fall. These retractables are usually equipped with a 3⁄16" wire rope cable or a 1" webbing lanyard of at least 4700 lb of anchorage strength. The retractables are equipped with shock absorbers that will limit the forces of a falling worker to 900 lb or less during a fall arrest. These shock absorbers may comprise an internal mechanical clutch type or an external rip-stop type made of webbing. The internal clutch mechanisms usually comprise a stack of friction disks which are held under a known compressive force by preloaded Bellville springs. The internal clutch mechanism normally is activated by a centrifugal pawl mechanism only after the falling worker achieves a certain velocity. The advantage of a mechanical clutch type shock absorber over a webbing rip-stop type shock absorber is that the former will activate much more quickly, which reduces input energy and creates a lower fall arrest force by limiting the worker fall height.

One of the difficulties of using mechanical retractable shock absorbing lifelines is that they must be periodically inspected for damage and be retested to confirm that they are operating correctly. This is usually done yearly and requires each fall arrest unit to be returned to the manufacturer for this recertification service. The reason these units must be returned to the manufacturer is because they are mechanically difficult to service due to the precision setting required on the clutch assembly and the difficulty of unloading and removing the power retraction springs, which may be over 100 ft. long. This is both costly and time consuming, requiring the customer to purchase extra units that can be rotated out of service for recertification on a regular schedule.

These problems are greatly compounded when retractable units are used in off-shore work sites where the retractables will be exposed to a salt (and thus, corrosive) atmosphere. In such conditions, the retractable must be serviced and recertified after approximately four months. Further, when a retractable is being serviced, it is out of commission for about two months.

BRIEF SUMMARY OF THE INVENTION

Briefly, a retractable fall arrestor is disclosed which is substantially corrosion resistant and which is made from component assemblies, thereby allowing workers in the field to replace any needed component of the retractable. Further, this "field repair" by using component replacement can be accomplished with the use of minimal tools, or preferably with no tools. The replaced components can then be returned to the manufacturer for technical service and recertification, as necessary.

The retractable fall arrest unit comprises a mechanically locking brake assembly component, a retractable power spring assembly component, a central drum and cable assembly component and a housing assembly component that allows the unit to be opened for removal and replacement of the cable drum assembly without requiring disassembly of any of the components. In a preferred embodiment, the unit will be opened around a hinge at a top handle or side of the unit; although the unit can be hinged or pinned for complete separation at any location around the frame assembly. Importantly, the unit can be opened without requiring the removal of a main shaft. Rather, the main shaft is comprised of two cantilevered shafts, one supported by the clutch assembly component and one supported by the spring assembly component. By splitting the main shaft into two cantilevered shafts, the two shafts can be brought together when the housing unit is closed to support the cable drum assembly component. In this way, the cable drum assembly component can be replaced without disassembly of either the spring assembly or the clutch assembly. Additionally, any of the four component assemblies can be replaced without requiring disassembly of any of the other components. Because of this component assembly, the clutch/brake assembly component can be assembled and sealed at the factory and can be permanently lubricated by being made to run in an oil bath. Similarly, the spring assembly component can be assembled and sealed at the factory and made to be permanently lubricated by running in an oil bath. Because the two components are sealed, no contaminates such as dirt, grit, sea water or caustic chemicals, that might attach to the cable can be drawn back into the clutch or spring assemblies. In the preferred embodiment, the housing would be stainless steel with a stainless steel cable and polymer drum to help prevent corrosion, even when used in an offshore environment.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 2:
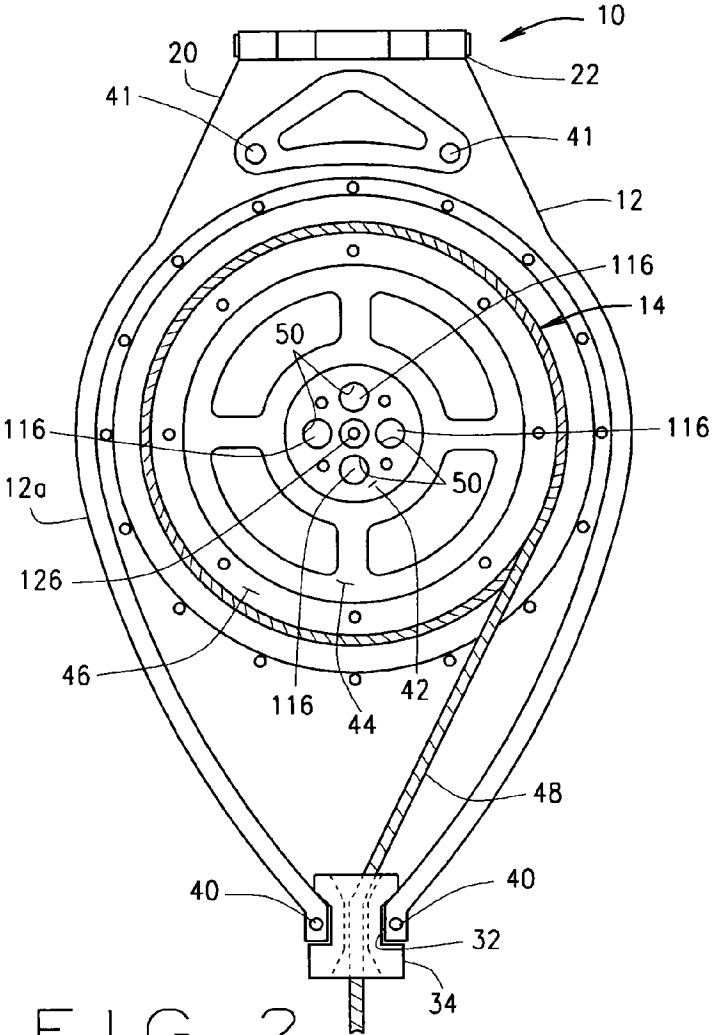
FIG. 2 is a plan view of the fall arrest unit with the spring assembly removed.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

Figure 1:
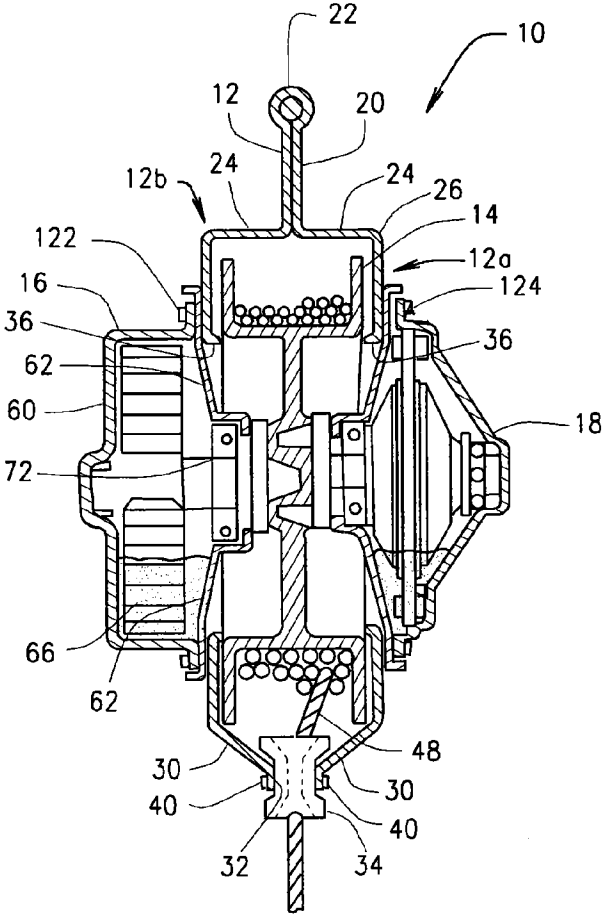
FIG. 1 is a cross-sectional view of a first illustrative embodiment of a retractable fall arrest unit.

Referring initially to FIG. 1, a retractable fall arrest unit 10 is comprised of four components: a housing 12, a drum 14, a spring sub-assembly 16, and a clutch/brake sub-assembly 18. As will be described in more detail below, the fall arrest unit 10 can be disassembled with few, if any, tools, to allow for replacement of the drum 14 in the field by an operator. Similarly, the spring sub-assembly 16 and clutch/brake sub-assembly 18 can be replaced in the field. Hence, the site where the retractable fall arrest unit 10 is being used need not stock replacement arrest units. Rather, the site need only stock replacement drums and sub-assemblies. This will substantially reduce the down time of a particular retractor.

The housing 12 comprises a first half 12*a* and a second half 12*b*. As seen in FIG. 2, the housing 12 is generally tear shaped in plan view. Illustratively, the two housing halves are pivotally connected together by a hinge 22. At its top, the housing includes a handle formed by complementary handle portions 20 in each housing half 12*a*, 12*b*. As seen in FIG. 1, the handle portions 20 are adjacent each other. At the bottom of the handle portions, the housing halves define housing top surfaces 24 which extend away the handle portions 20. Outer surfaces 26 extend downwardly from the top surface. At the bottom of the outer surfaces, the housing halves include inwardly sloping surfaces 30 which, at the bottom of the housing, define an opening or outlet 32. A nozzle 34 is positioned at this opening. As can be gleaned from FIGS. 1 and 2, the nozzle 34 is generally centered at the bottom of the housing 12. The housing outer surfaces 26 each define a central opening 36, and the two openings 36 are aligned with each other. As seen in FIG. 1, the housing includes an inwardly turned flange 38 around the periphery of the openings 36.

As noted above, the two housing halves 12*a*, 12*b* are connected together at their tops by the hinge 22. The bottoms of the housing halves are held together by screws 40 which extend through the housing halves into the nozzle 34. Hence, each housing half is independently connected to the nozzle (as opposed to being directly connected to each other). As will be described below, because the nozzle is secured to the housing halves, when one of the screws 40 is removed to open the housing, the nozzle 34 will remain connected to the opposite housing half. Additional screws 41 are provided at the handle 20. Although the housing halves 12*a*, 12*b* are shown to be hinged together at the top of the housing, the hinge could be placed along a side of the housing. Further, the hinge could be dispensed with altogether, such that the two housing halves can be separated by pulling the two halves apart. In this instance, the housing halves may be provided with positioning pins and holes to facilitate assembly of the housing during a replacement procedure.

Figure 6:
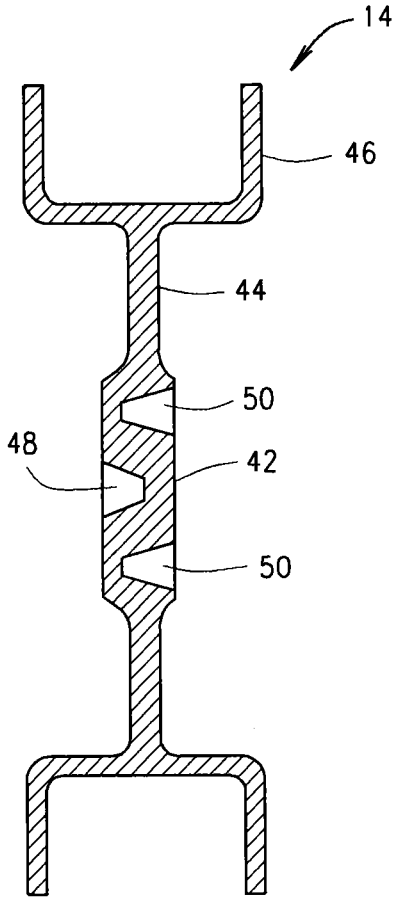
FIG. 6 is a cross-sectional view of the drum of the fall arrest unit.

With reference to FIG. 6, the drum 14 comprises a central body 42, a plate or flange 44 extending from the body 42, and a generally U-shaped spool or reel portion 46 at the outer end of the flange 44. The spool portion receives a cable 48, which is wound about the spool portion. When the fall arrest unit is assembled, the drum body 42 and drum flange 44 are generally aligned with the openings 36 in the housing outer surfaces. In fact, the drum body 42 is co-axially aligned with the housing outer openings 36. The spool portion 46 is positioned in the radial outer portion of the unit housing (i.e., radially beyond the openings 38, and the wall of the spool portion is sized to be received in the annular channel defined by the housing wall 24, the outer wall 26, and the peripheral flange 38. As best seen in FIG. 6, the drum assembly body 42 includes a central bore 48 on one side of the body and a plurality of bores 50 on the opposite side of the body 42. The central bore 48 is centered relative to the drum assembly body 42 (and thus centered relative to the housing openings 36). The bores 50, on the opposite side of the body 42) are spaced radially from the central bore 48. For example, there can be four bores 50 spaced around the body 42. The bores 48 and 50 are all preferably shaped as a truncated cone (i.e., have inwardly sloping walls).

Figure 3:
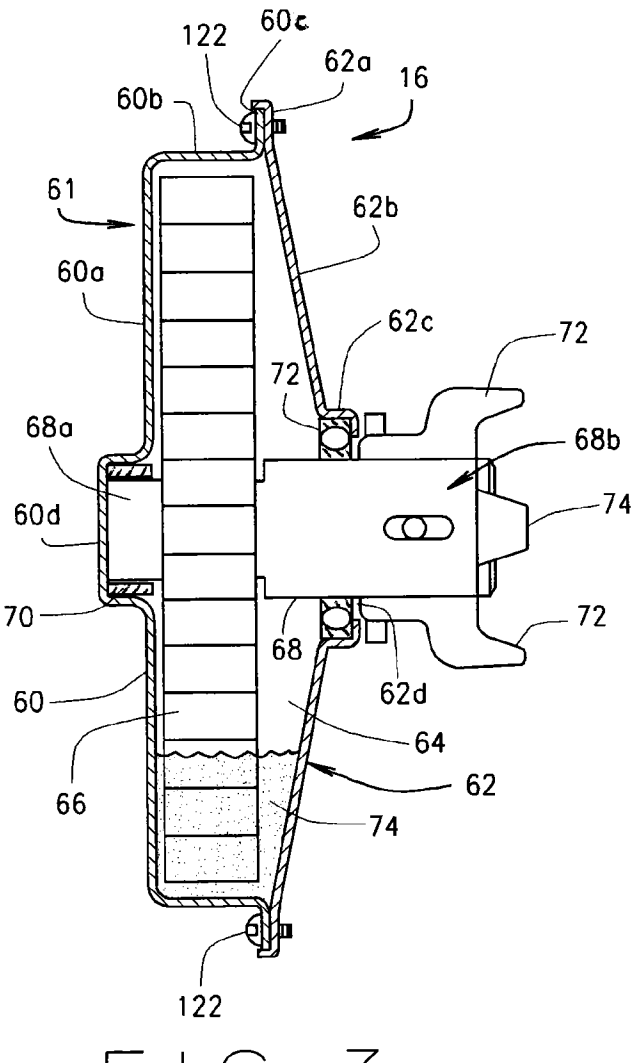
FIG. 3 is an enlarged cross-sectional view of the spring component assembly of the fall arrest unit.
Figure 5A:
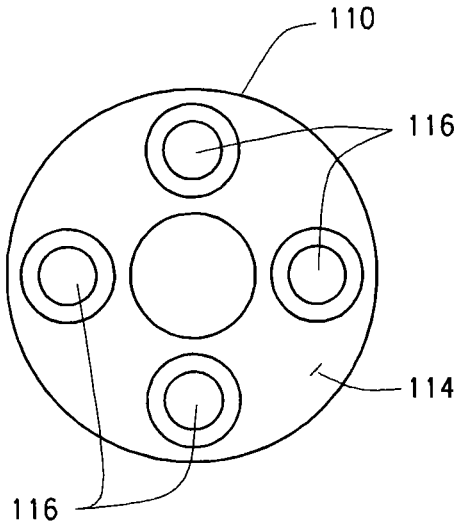
FIGS. 5A and 5B are plan and side views, respectively of a hub component.
Figure 5B:
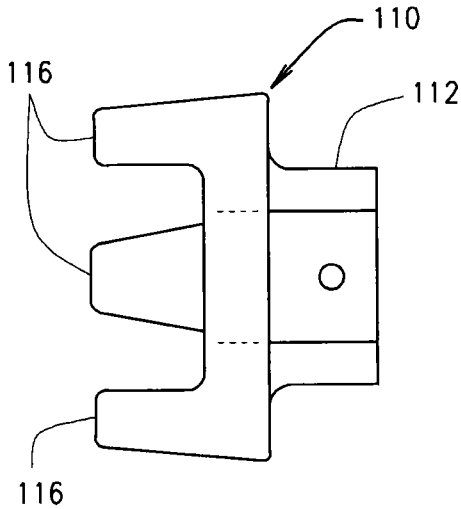

With reference to FIG. 3, the spring sub-assembly 16 includes a spring housing 61 comprising an outer cover 60 and an inner cover 62, which are generally circular in plan. The outer cover 60 includes an outer surface 60*a*, a side surface 60*b*, and an attachment flange 60*c* extending radially outwardly from the side surface 60*b*. A central, generally cylindrical projection 60*d* extends from the outer surface 60*d* of the outer cover 60. The inner cover 62 includes an annular attachment flange 62*a*, and a generally conical surface 62*b*. An annular shoulder 62*c* defining a central opening 62*d* is formed at the center of the inner cover 62. The inner cover 62 and outer cover 60 are connected together along their respective connecting flanges, and when connected, the inner and outer covers define a chamber 64. A spring 66 which is wound about a spring body (not shown) is received in the chamber 64. The spring 66 can be a single spring for smaller retractables or a plurality of springs connected together in series for larger retractables.

A cantilevered spring shaft 68 extends through the spring body, and the spring body (and thus the spring) is positionally fixed to the shaft 68, such that the center (or first end) of the spring and shaft rotate together. The other end of the spring is secured to the housing 60*a*. The cantilevered spring shaft 68 includes an outer portion 68*a* which is received in the cylindrical projection 60*d* of the cover 60 and an inner portion 68*b* which extends from the spring body through the opening 62*d* in the inner cover 62. The cantilevered spring shaft is rotationally supported in the housing 61 by a roller bearing 70 at the spring shaft outer end 68*a* and a ball bearing 72 at the spring shaft inner portion 68*b*. As seen, the roller bearing 70 is positioned in the cylindrical projection 60*d* of the housing outer cover 60. The roller bearing can be a tapered roller bearing so as to take thrust loads. The ball bearing 72 is positioned in the bearing shoulder 62*c* of the housing inner cover 62. The cantilevered spring shaft 68 extends beyond the inner cover 62.

The inner end of the cantilevered spring shaft 68 comprises a central pin 74 which is received in the central opening 48 of the drum body 42 and outer fingers 76 which grippingly engage the drum body 42. The engagement of the fingers 76 with the drum body 42 is such that the drum body 42 (and hence the drum 14) and the spring shaft 68 are rotationally fixed relative to each other. The fingers 76 can be part of a drive hub that is rotationally fixed relative to the cantilevered spring shaft 68; or the fingers can be integrally formed with the shaft.

The junction between the inner cover 60 and outer cover 62 of the spring housing 61 is preferably sealed, as is the junction between the ball bearing 72 and the inner cover 62. Hence, the spring sub-assembly 16 is a sealed component of the fall arrest unit. The chamber 64 defined by the housing 61 is provided with a lubricant 74, such as oil, so that the spring 66 will remain lubricated and to help prevent corrosion of the spring 66.

Figure 4:
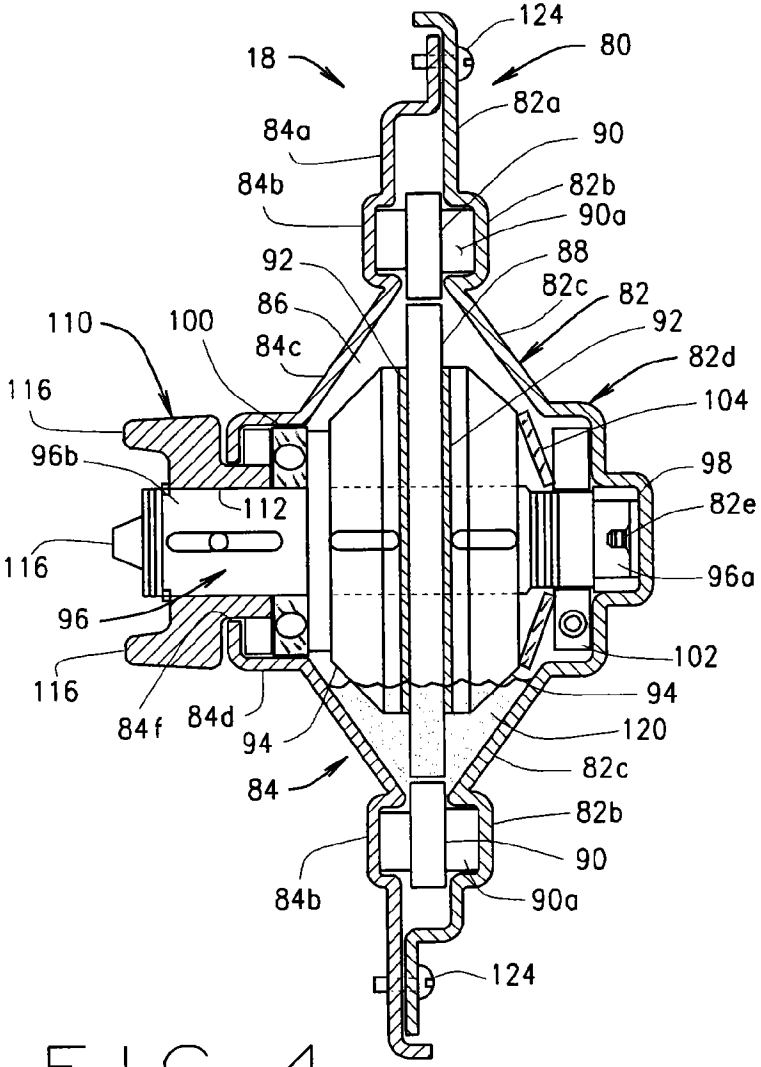
FIG. 4 is an enlarged cross-sectional view of the clutch/brake assembly of the fall arrest unit.

The brake/clutch assembly 18 is shown in greater detail in FIG. 4. The clutch/brake assembly 18 includes a brake/clutch housing 80 comprised of an outer cover 82 and an inner cover 84. The outer cover 82 includes an annular generally flat portion 82*a* with a plurality of generally cylindrical outwardly extending projections 82*b* formed therein. The projections 82*b* define a circle. A frustoconical surface 82*c* extends outwardly from the circle defined by the projections 82*b*. A first generally cylindrical portion 82*d* is formed at the outer end of the frustoconical wall 82*c*; and a second, smaller generally cylindrical portion 82*e* is formed concentrically with the first generally cylindrical portion 82*d*. The housing inner cover 84 is shaped complementarily to the outer cover 82. To this end, the inner cover 84 includes an annular generally flat portion 84*a* with a plurality of generally cylindrical outwardly extending projections 84*b* formed there in. The projections 84*b* define a circle, and are positioned to be aligned with the projections 82*b* of the outer cover 82. A frustoconical surface 84*c* extends outwardly from the circle defined by the projections 84*b*. A generally cylindrical wall 82*d* extends outwardly from the outer end of the frustoconical surface 84*c*. A flange 84*e* extends inwardly from the end of the cylindrical wall 84*d* to define a central opening 84*f* in the inner cover 84. The opening 84*f* is aligned with the cylindrical portions 82*d* and 82*e* of the outer cover 82. The inner and outer covers are secured together proximate the periphery of the covers 82 and 84 to define an inner chamber 86.

Figure 8:
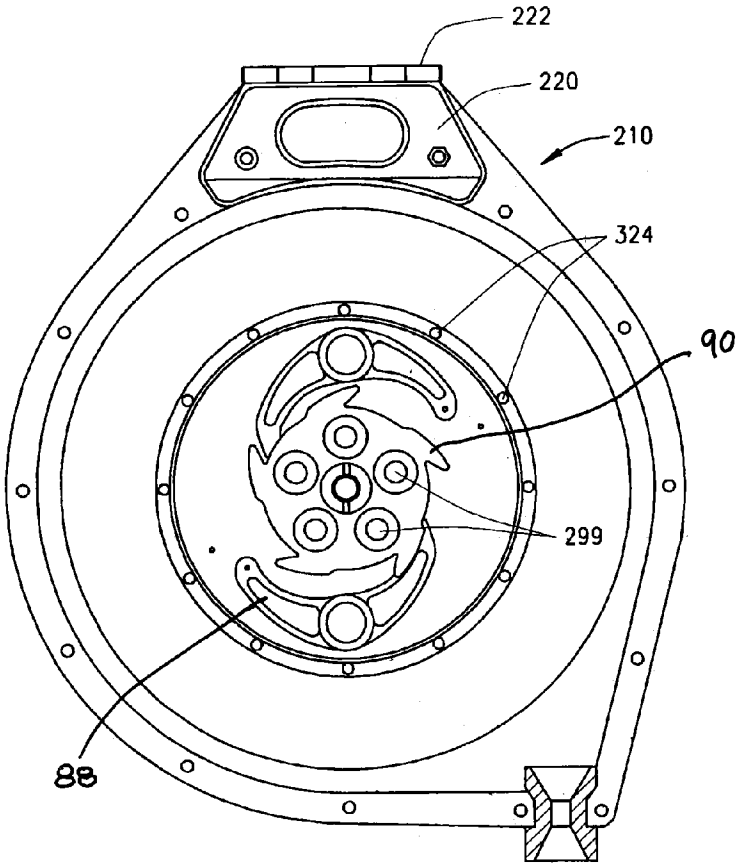
FIG. 8 is a plan view of the fall arrest unit of FIG. 7 with the spring assembly removed.
Figure 7:
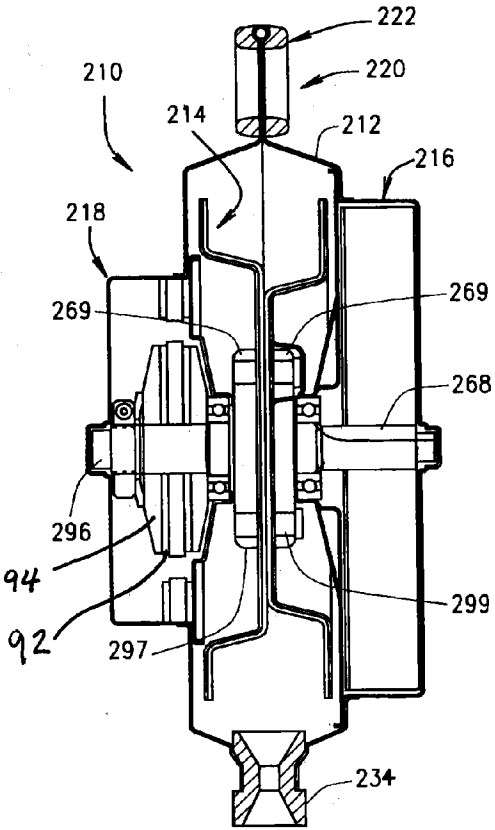
FIG. 7 is a cross-sectional view of a second illustrative embodiment of the fall arrest unit.

Internally, the brake/clutch assembly includes a sperrad or ratchet plate 88 which is rotationally mounted in the housing 86 and a plurality of pawls 90. The pawls 90 are mounted on pawl axles 90*a* which are received in the aligned cylindrical projections 82*b* and 84*b* of the outer and inner covers, respectively. As can be appreciated, the pawls 90 are sized and shaped to engage teeth of ratchet plate, as seen in FIG. 8. to prevent rotation of the ratchet plate in one direction while allowing for rotation of the ratchet plate in the opposite direction. A brake friction pad 92 is positioned on either side of the ratchet plate 88, and brake drums 94 are positioned on either side of the friction pads 92.

A cantilevered brake/clutch shaft 96 extends through the brake drums 94, the brake friction pad 92 and the ratchet plate 88 to rotationally support the brake drums, friction pads, and ratchet plate in the brake/clutch housing 80. The ratchet plate 88 is rotationally fixed to the shaft 96. The shaft 96 includes an outer portion 96*a* and an inner portion 96*b*. The shaft outer portion 96*a* is received in the second cylindrical projection 82*e* of the housing outer cover 82. The shaft inner portion 96*b* extends through the opening 84*f* in the housing inner cover 84. To facilitate rotation of the shaft 96 in the housing, the shaft outer end 96*a* is supported by roller bearings 98 in the second cylindrical projection 82*e* of the outer cover 82; and the shaft inner end 96*b* is supported by ball bearings 100 positioned within the cylindrical wall 84*d* of the housing inner cover 82. The roller bearing 98 can be a tapered roller bearing to take thrust loads. A Belleville spring lock nut 102 is positioned in the first cylindrical projection 82*d* of the outer cover, and a Belleville washer 104 (or other spring member) is positioned between the Belleville spring lock nut 102 and the brake drum 94 to preload the brake friction disks 92. The Belleville spring lock nut is rotated to preload the Belleville spring 104. The lock nut includes a set screw which holds the rotational position of the lock nut.

A drive hub 110 is received on the end of the brake/clutch shaft 96. The drive hub 110 includes a hollow sleeve 112 sized to fit over the end of the shaft 96. The sleeve 112 is fixed to the shaft 96, so that the hub and shaft are rotationally fixed relative to each other. A plate or flange 114 extends outwardly from the end of the sleeve 112, and a plurality of drive pins 116 extend forwardly from the flange 114. The pins 116 are generally frustoconical in shape and are sized to be received in the bores 50 of the drum body 42. The brake/clutch shaft 96 is narrower in diameter (at its inner end 96*b*) than the central opening 84*f* of the housing inner cover 84. However, the outer diameter of the hub sleeve 112 is sized to be received within the central opening 84*f*, as seen in FIG. 4. A spacer/seal 118 surrounds the hub sleeve 112 within the cylindrical wall 84*d* of the inner cover 84, and is positioned between the inner cover flange 84*e* and the ball bearing assembly 100.

As with the spring assembly, the brake/clutch assembly is sealed, such that the chamber 86 can be provided with an oil bath 120 to help protect the brake/clutch components from corrosion.

Preferably, the connection between the flanges is sealed. To this end, a seal can be provided between the flat annular surfaces 82*a* and 84*a* of the outer and inner covers 82 and 84, respectively. Additionally, the seal/spacer 118 will form a seal between the hub sleeve 112 and the housing inner cover 84 to prevent seepage of oil through the opening 84*e* of the inner cover 84.

With reference to FIG. 1, the spring assembly 16 is secured to the fall arrest housing 12 by means of screws 122 or other fasteners. These are, in part, the same screws which hold the inner and outer covers of the spring housing together. One set of screws holds both sides of the spring housing together, and another set of screws goes through holes in both the inner and outer spring housing plates to attach the spring sub-assembly to the unit housing. The use of the two sets of screws, as just described, allows for the spring sub-assembly to be removed from the unit housing without losing its oil seal. Similarly, the brake/clutch assembly 18 is secured to the fall arrest housing 12 by means of screws 124. As with the spring sub-assembly, there can be two sets of screws: one set which holds the brake/clutch housing together, and another set which secures the brake/clutch housing to the unit housing. Additionally, there is an inner screw 126 (FIG. 2) which extends through the drum body 42 into the cantilevered shaft 68 of the spring assembly.

The spring shaft 68 and the brake/clutch shaft 96 are operatively connected together through the intermediary of the drum body 42. As noted, each shaft 68 and 96 is rotationally fixed to the drum body 42, and hence the two shafts will rotate in unison. When unit 10 is assembled so that the two sides of the housing 12 are closed on the drum 14, there is a tight fit into the center of the drum (i.e., the drum body), so that there is substantially no wobble or looseness in the drum as it rotates during use.

The construction of the fall arrest 10, and in particular, the use of sealed components allows for easy replacement of components in the field. A repair of the fall arrest can be conducted as follows:

1. Place the fall arrest unit 10 on a work surface with the spring assembly 16 down, and the brake/clutch assembly up;
2. Remove the nozzle screws 40 and the handle screws 41.
3. Lift the unit housing half 12*a* (to which the brake/clutch assembly is mounted) and pivot it about the hinge 22. The drum 14 will stay connected to the spring assembly because of the screw 126.
4. Lift the nozzle out of the spring side 12*b* of the unit housing 12, and, while holding on to the cable, unwind the cable until all pre-wraps are removed from the power spring 66.
5. Remove the drum screw 126 from the spring side cantilevered shaft 68 and lift the drum assembly out of the fall arrest housing 12 and set aside for replacement if defective.
6. With the housing 12 opened, turn the housing over to expose the outer covers of the spring assembly housing and the brake/clutch assembly housing. As noted below, the unit housing can be adapted so that the spring sub-assembly and the brake/clutch sub-assembly are removed from the inside of the housing, thus negating the need to turn the opened housing assembly over to remove the sub-assemblies from the unit housing. In a unit in which the sub-assemblies are mounted to the inside of the unit housing, even if the screws which held the sub-assemblies to the unit housing were to come out, the sub-assemblies would not separate from the unit housing. This could only happen if the unit housing were opened.
7. Loosen the screws 122 and 124 to remove the spring assembly and the clutch assembly, respectively, from the fall arrest housing 12.

If any of the components are not defective, or do not need servicing, they need not be removed. Any of the components which are defective or which otherwise need servicing can be replaced with spare components. Reassembly is simply conducted in reverse of the steps outlined above. Hence, for example, it may be that only the drum assembly needs replacement. As can be appreciated, the use of the sealed components/assemblies allows for easy field replacement of desired components with the use of only a screw driver. Because the spring 66 is sealed within the spring assembly housing, the worker need not worry about the spring coming unwound. Similarly, the worker need not be concerned about the components of the brake/clutch assembly.

A second illustrative embodiment of the fall arrest is shown in FIGS. 7-9B. The fall arrest 210, like the fall arrest 10, comprises a housing 212 comprised of two sides which are connected together at a handle area 220 by a hinge 222. The fall arrest unit 210 includes a drum assembly 214, a spring assembly 216 and a brake/clutch assembly 218. The housing 212 is generally similar to the housing 12. However, rather than being tear drop shaped, the housing is more circular in plan. This allows for the nozzle 234 to be positioned below the periphery of the drum 214 (rather than centered relative to the drum) as seen in FIG. 8. This positioning of the nozzle reduces (or substantially eliminates) the bend or angle introduced in the cable as the cable is directed from the drum spool area to the nozzle (which can be seen in FIG. 1). The nozzle 234 is provided with grooves 235 (FIG. 10), and the housing halves are provided with arced sections 236 which snappingly engage the groove 235 of the nozzle 234. Hence, the screws which connect the nozzle to the housing halves have been eliminated.

Figure 9B:
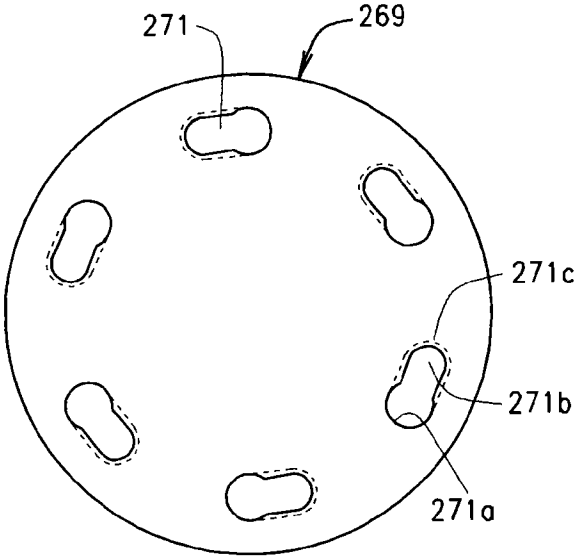
FIG. 9B is a plan view of one of the drive plates of the fall arrest unit of FIG. 7
Figure 9A:
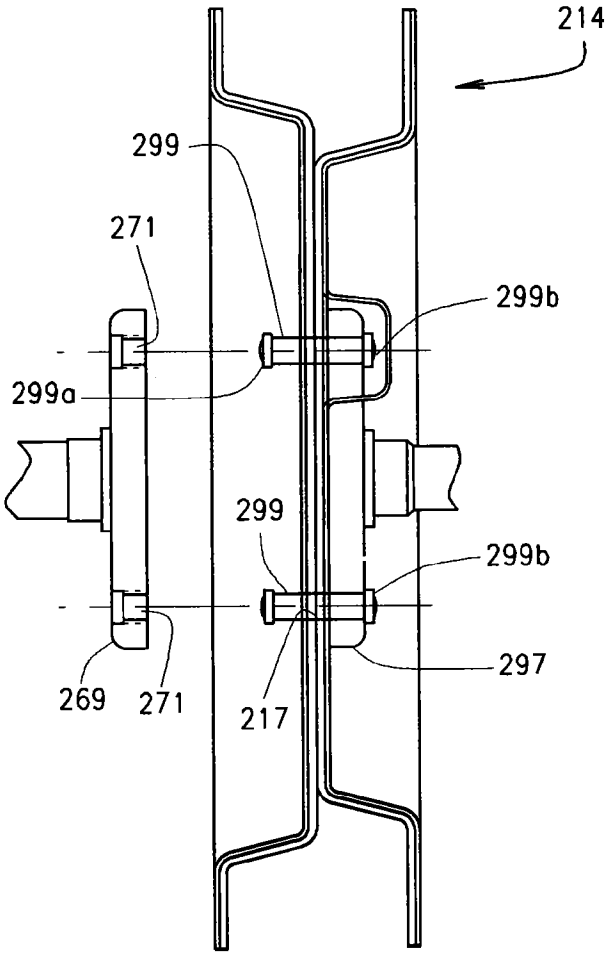
FIG. 9A is a side elevational view of the drum and drive plates of the fall arrest unit of FIG. 7.
Figure 10:
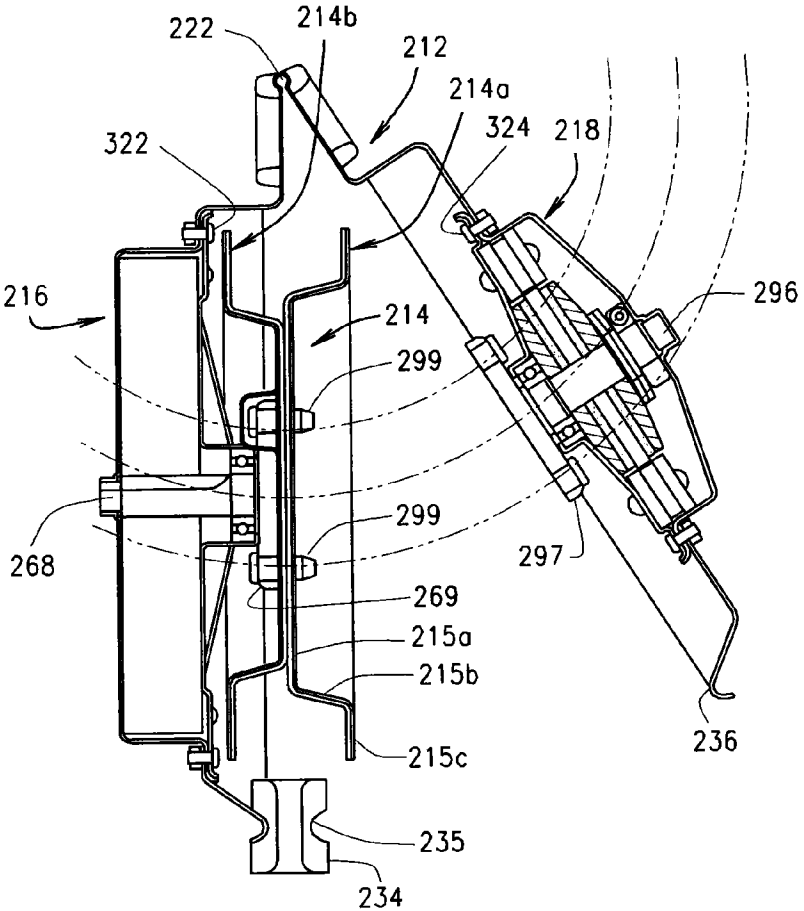
FIG. 10 is a cross-sectional view of the fall arrest unit of FIG. 7, showing the fall arrest unit being opened for service.
Figure 13:
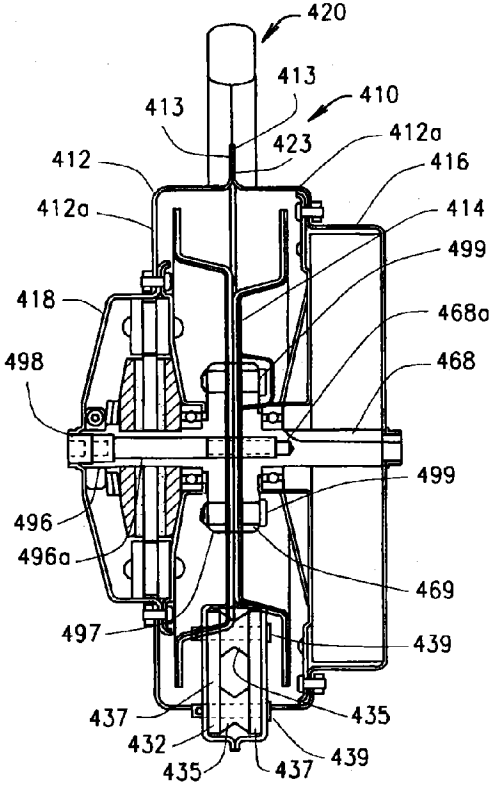
FIG. 13 is a cross-sectional view of the fall arrest unit taken along line 13-13 of FIG. 12.

The spring assembly 216 and the brake/clutch assembly 218 are substantially similar to the spring assembly 16 and the brake/clutch assembly 18 of the fall arrest unit 10. However, the drive connection between their respective shafts 268 and 296 and the drum assembly 214 is altered. As seen, the drum assembly is formed from two parts 214*a* and 214*b*. These two parts are similar to each other, in that each comprises a central section 215*a*, a sloping floor section 215*b*, and a wall section 215*c*. The floor sections 215*b* and the wall sections 215*c* in combination define the spool or reel portion of the drum about which the cable is wound. However, as seen, the central portion 215*a* of the drum portion 214*a* is larger in diameter than the central portion of the drum potion 214*b*. This makes the spool portion deeper on one side of the drum than the other. The central portion of the drum is provided with a plurality of holes 217. (FIG. 9A).

The spring and brake/clutch shafts 268 and 296 are each provided with a drive plate 269 and 297, respectively, which extend from their respective shafts. The plates 269 and 297 can be integral with their respective shafts, or can be separate pieces which are fixed to the shafts. The drive plate 269 is provided with a plurality of key-hole shaped slots 271, each slot 271 including a generally circular head portion 271*a* and an elongate leg portion 271*b*. The head portion 271*a* is of constant diameter, and extends through the plate 269. However, the elongate leg portion 271*b* is undercut to define a ledge 271*c*. The key hole slots 271 are positioned on the drive plate such that the head portions 271*a* of the slots can align with the holes 217 in the drum 214. Drive pins 299 extend from the drive plate 269. The pins 299 are positioned on the drive plate 269 to align with the holes 217 of the drum and the key hole slots 271 of the spring drive plate 269. The pins 299 include heads 299*a* which are sized to pass through the drum holes 217 and through the head portions 271*a* of the key hole slots 271. However, the pin heads 299*a* have a diameter greater than the elongate leg 271*b* extending from the head portion 271*a* of the key hole slots 271. Rather the pin is sized to extend through the narrower leg slot 271*a*. As can be appreciated, when the pin head 299*a* is passed through the drum hole 217 and the head portion 271*a* of the key hole slot, if the two drive plates are rotated relative to each other, the pin head 299*a* will pass from the head portion of the key hole slot to the leg portion of the key hole slot. Here, the pin head will engage the ledge 271*c* of the key hole slot, and the pin will not be able to be pulled through the slot. The pins 299 thus hold the drive plates 269 and 297 and the drum 214 together. When the fall arrest unit 210 is assembled and operational, the spring of the spring assembly will be preloaded so that it will normally operate to retract the cable into the housing. This preload of the spring will cause the spring to apply a rotational force to the spring drive plate to rotate the spring drive plate relative to the brake/clutch drive plate. This rotational force will maintain the pin heads 299*a* in engagement with the ledge 271*c* of the key hole slot 271, thereby substantially maintaining the connection of the drive plates (and hence the spring shaft and brake/clutch shaft) together. Because the spring is applying a torque to the shafts to hold the pins 299 in engagement with the key holes 271, this preload must be overcome to disassemble the unit to replace any of the components. The step 4 noted above (i.e., unwinding of the cable) releases this preload to allow the brake/clutch shaft (and hence the brake/clutch drive plate) to be rotated relative to the spring shaft (and hence the spring drive plate) to bring the pins into alignment with the head opening of the key hole slot. Once the pin heads are aligned with the head opening, the spring assembly and the brake/clutch assembly can be separated from the drum.

The pins 299 are describe to extend from the brake/clutch drive plate 297. The fall arrest unit 210 could be constructed such that the pins 299 extend from the spring drive plate and the key hole slots could be in the brake/clutch drive plate. Alternatively, each plate could be provided with both pins and key hole slots. Further, the pins can be integral with the drive plate(s) from which they extend. Alternatively, the pins can be separate from the drive plates. In this instance, the pins would be provided with a second head 299*b*, and each drive plate 269 and 297 would be provided with key hole slots. In this instance, the key hole slots in each plate would be configured to take advantage of the preload of the spring of the spring sub-assembly, so that the spring would force the pin heads to be engaged in the narrower leg portion of the key hole slots, so that the pin heads will form an interference fit with the ledges of the key hole slots. In another alternative, the pins could extend from the drum, and each of the drive plates could be provided with key-hole slots. Again, the key hole slots would be arranged such that spring would force the pin heads to be engaged in the narrower leg portion of the key hole slots, so that the pin heads will form an interference fit with the ledges of the key hole slots.

Additionally, the screws 322 and 324 (FIG. 10) which secure the spring sub-assembly and the brake/clutch sub-assembly, respectively to their respective housing halves, have their heads on the inside, rather than the outside of the housing. This allows for these screws to be driven into place (or loosened) to secure the sub-assemblies to the housing halves while the housing is lying opened (and without the need to flip the opened housing, as with the fall arrest unit 10).

As can be appreciated, in the fall arrest unit 210, screws are not used to hold the two housing halves together, nor are screws used to secure the drum 214 in place in the housing 212. Thus, the drum 214 can be replaced without the use of tools. However, at least a screwdriver would be needed to remove and replace the spring assembly 216 and/or the brake/clutch assembly 218.

Figure 11:
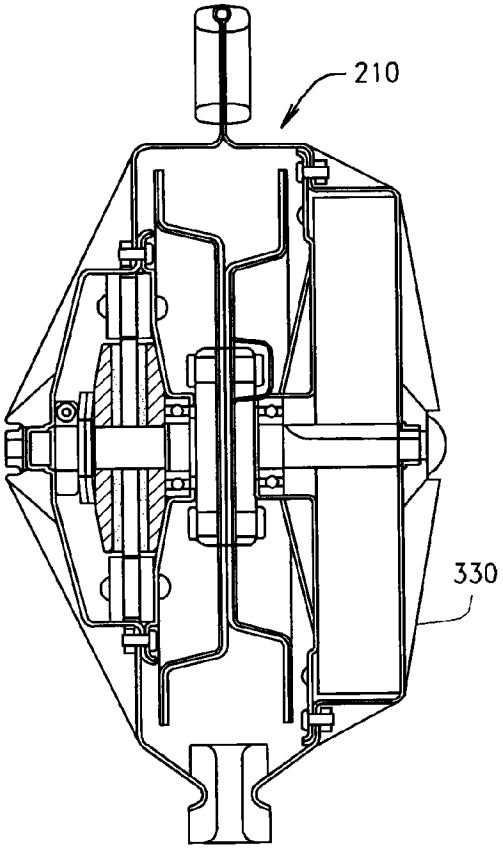
FIG. 11 is a cross-sectional view of the fall arrest unit of FIG. 7 provided with an overlay.

FIG. 11 shows the fall arrest assembly 210 with a plastic cover 330 which substantially surrounds and encapsulates the fall arrest unit 210, while leaving the nozzle 324 open.

FIGS. 12-17 show a third embodiment 410 of the fall arrest assembly, which is similar in several respects to the fall arrest assembly 210. The spring sub-assembly 416 has a spring shaft with a mounting plate 469 at its inner end which is inside the unit housing chamber when the fall arrest unit is assembled. The brake/clutch sub-assembly includes a brake/clutch shaft with a mounting plate 497 at its inner end. Like the mounting plate 469, the mounting plate 497 is positioned within the chamber of the unit housing. As with the fall arrest unit 210, pins 499 are provided which extend through the mounting plates and the drum assembly 314. In this embodiment, the pins 499 have a positive taper to help with alignment as the two sides 312*a* and 312*b* of the unit housing 312 are brought together on the pins, as opposed to the key hole pins or the reverse taper pins of units 10 and 210, respectively.

The housing 412 of the fall arrest unit 410 defines an outlet 432, which is positioned at the bottom, and to side of the housing, as is the outlet in the fall arrest unit 210. It has been found that during use, the cable will readily wear away a plastic nozzle and the cable can be damaged by a steel nozzle. To prevent damage to the cable, the steel nozzle must be hardened, and to protect the steel nozzle from corrosive elements (i.e., salt water), the steel nozzle must be coated, This treatment to the nozzle adds expense to the nozzle, and thus expense to the unit as a whole. Thus, rather than using a nozzle, as in the fall arrest units 10 and 210, the outlet 432 of the fall arrest unit 410 is provided with a pair of spaced apart rollers 435 which are positioned in the outlet 432 by means of shims 437. A pin 439 extends through the housing, the shims and each roller 435 to rotatably mount the rollers in the outlet 432. The pins 439 can, for example, be bolts, but are preferably unthreaded and are secured to the housing be a spring-type connection (i.e., a spring loaded ball or finger which is received in a groove or hole.

Figure 12:
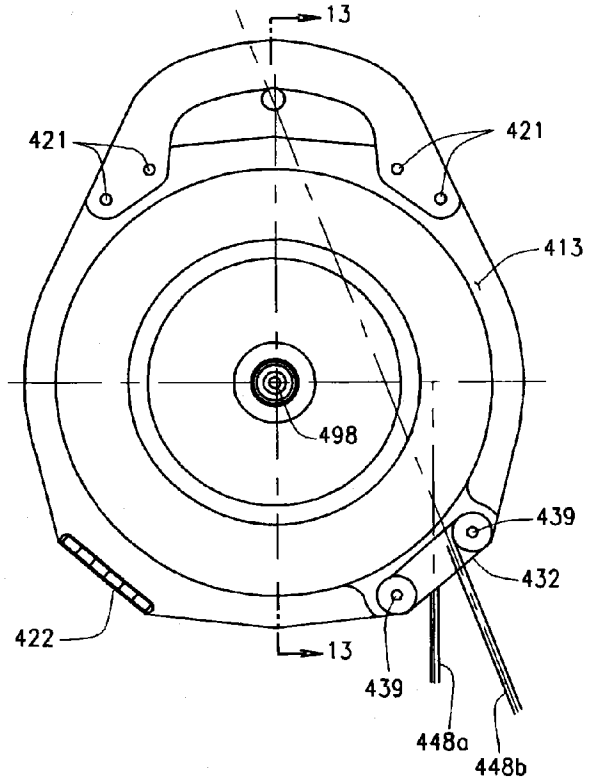
FIG. 12 is a plan view of a third embodiment of the fall arrest unit.

In FIG. 12, two cable fragments are depicted. The cable fragment 448*a* represents the position of the unit's cable when the unit is at rest (i.e., a worker is working normally). In this instance, the cable exits the outlet 432 between the rollers 435, generally without contacting the rollers. The second cable fragment 448*b* represents the position of the cable when the unit is loaded (i.e., during a fall). In this instance the cable will engage the top roller.

Lastly, with respect to the outlet 432, it can be seen that the outlet is substantially wider than the rollers 435, The width of the outlet allows the same housing to be used with either a cable or a web. As shown, the rollers 435 are generally V-shaped, and are for use with cable. However, by replacing the V-shaped rollers with cylindrical rollers, and by replacing the shims with 437 with thinner shims, the unit can be converted for use with a web rather than a cable.

A handle 420 is mounted to the top of the housing 412. The handle 420 is a separate element with a groove 423 which receives flanges 413 of the housing unit halves 412*a* and 412*b*. The handle is secured to the housing by pins 421 which extend through the handle and the housing flanges 413. As with the roller pins 439, the pins 421 can have threaded ends. However, they are preferably removably secured by a spring connection, such as a spring mounted ball or finger which is received in a groove or hole. The pins 439 and 421 are all substantially strong enough to withstand the forces that will be applied to them in a fall. To this extent, the pins can be, for example, ¼" diameter steel pins.

As best seen in FIG. 12, in the fall arrest unit 410, the hinge 422 is positioned near the bottom of the housing 412, and is approximately level with the housing exit, rather than at the handle as in the units 10 and 210.

As can be appreciated, the two sides 412*a* and 412*b* of the housing 412 for the fall assembly 410 are secured together at essentially three locations—the handle 420, the outlet 434 and the hinge 422. Because the pins are secured in place by a spring-type connection, as noted above, the pins can be removed without the use of tools. This allows for opening of the housing without the need for tools. If desired, and as noted above, the pins could have threaded end. However, this would necessitate a tool (in the form of a screw driver, wrench, etc.) to open the housing 412 for replacement of selected assemblies. In one variation, the hinge 422 could be replaced with pins. This would allow for the two pieces of the housing pulled apart, rather than pivoted apart.

Figure 15:
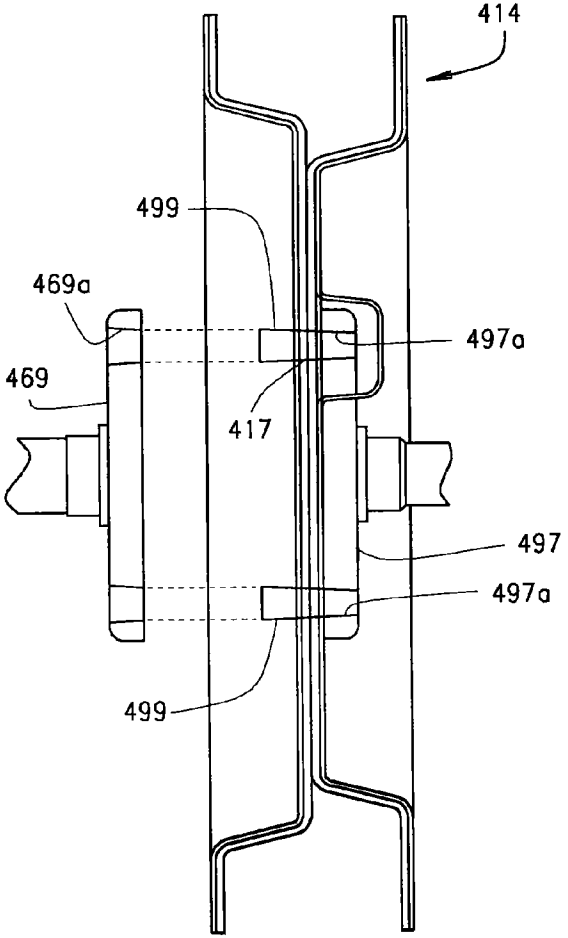
FIG. 15 is a side elevational view of the drum and drive plates of the fall arrest unit of FIG. 12.
Figure 14:
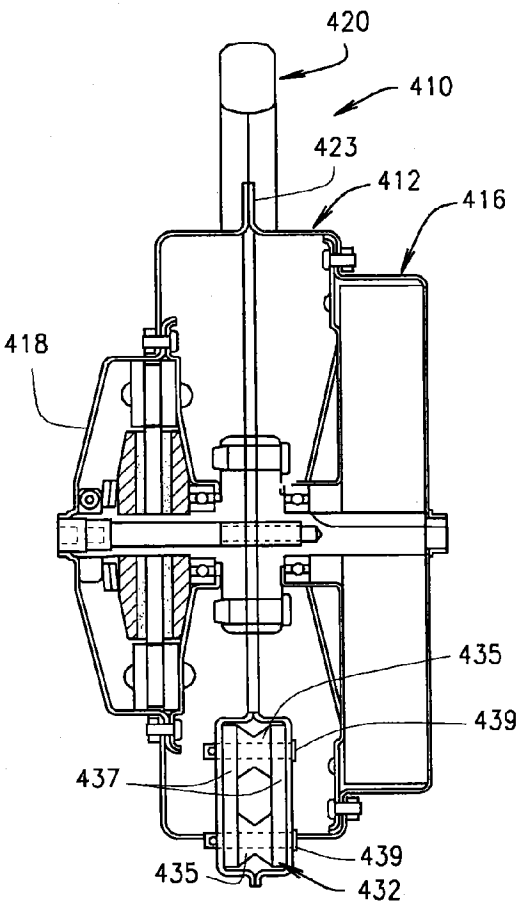
FIG. 14 is a cross-sectional view of the fall arrest unit similar to the view of FIG. 13, but with the drum assembly removed.
Figure 16:
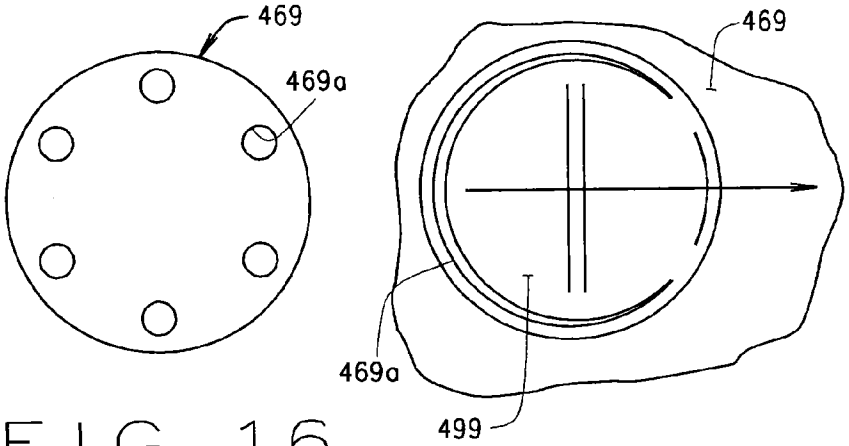
FIG. 16 is a plan view of one of the drive plates of the fall arrest unit of FIG. 12.
Figure 17:
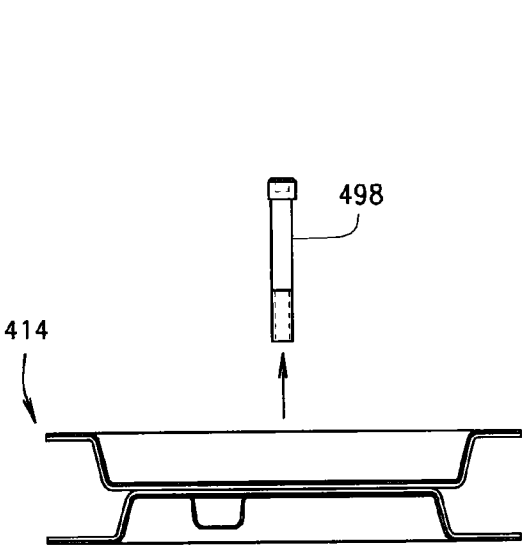
FIG. 17 is a greatly enlarged fragmentary plan view of a pin received in a pin hole of a shaft drive plate in the fall arrest unit of FIG. 12, and demonstrating the effect of a torque applied to the drive plate.

A further difference between the fall arrest units 210 and 410 is in the connection between the shafts 468 and 496. Initially, the spring shaft 468 includes a bore 468*a* which extends inwardly from the center of the spring shaft mounting plate 469; and the brake/clutch shaft 496 includes a bore 496*a* which extends through the shaft, and is opened at both the outer end of the shaft (i.e., at the outer wall of the brake/clutch assembly) and at the surface of the brake/clutch mounting plate 497. When the fall arrest unit 410 is assembled, the bores 468*a* and 496*a* will be aligned with each other. A retractable bolt 498 extends through the bore 496*a* of the brake/clutch shaft into the bore 468*a* of the spring shaft. The end of the bolt will engage the spring shaft bore 468*a* to, in part, hold the two sides of the unit's housing together. The bolt 498 and the spring shaft bore 468*a* can both be threaded, such that the bolt is threaded into the bore 468*a*. Alternatively, as with the pins 439 and 421, the bolt could be provided with a spring mounted ball or finger which is received in a groove or hole in the shaft bore to provide a spring-type connection of the bolt in the shaft bore. This latter variation would allow for removal of the bolt 498 without the need for tools. Additionally, the drive plates 469 and 497 are provided with tapered holes 469*a* and 497*a*, respectively, and the pins 499 are tapered, as best shown in FIG. 15. As with the fall arrest unit 210, the drum includes holes 417. The holes 469*a* and 497*a* of the drive plates are positioned to align with each other and with the holes 417 of the drum. As seen in FIG. 15, the tapered holes 469*a* of the spring drive plate 469 have a greater diameter than the tapered holes 497*a* of the brake/clutch drive plate 497. Additionally, the tapered holes 469*a* of the spring plate are sized to receive the wide end of the pin 499. When the fall arrest unit 410 is assembled, the tapered pins 499 extend through the spring drive plate, the holes 417 in the drum 414, and the holes 497*a* of the brake/clutch drive plate 497. The wide end of the pin 499 is received in the hole 469*a* of the spring drive plate 469, and the narrower end of the pin 499 is received in the holes 497*a* of the brake/clutch drive plate 497. The spring drive plate holes 469*a*, as noted, have a diameter slightly larger than the wide end of the pin 499, so as to allow the wide end of the pin to be received into the narrower end of the tapered hole 469*a*. However, the angle of the taper of the hole 469*a* corresponds to the angle of the taper of the pin. When the fall arrest unit 410 is loaded (i.e., the spring of the spring assembly applies a torque to the spring shaft and spring drive plate), the torque will push the pins to one side of the hole, as shown in FIG. 17. The interaction of the pins 499 with the holes will generate a force that will hold the assembly (i.e. the spring shaft, the drum, and the brake/clutch shaft) together. Additionally, this interaction will help prevent the unit housing from opening under the force of a fall.

Figure 18:
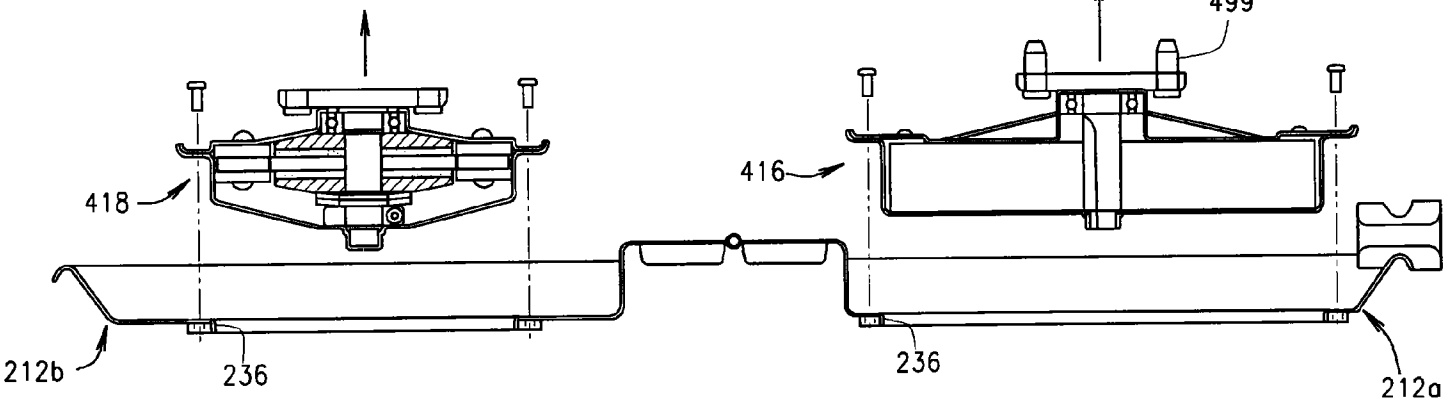
FIG. 18 is an exploded view of the fall arrest unit.

Lastly, FIG. 18 shows a fall arrest assembly in an exploded view. This fall arrest assembly includes the housing 212, the spring sub-assembly 418, the brake/clutch sub-assembly 416 and the drum 414. As seen, the sub-assemblies are inserted into the housing halves 212*b* and 212*a* from the inside, and pass through the wall openings 236 in the housing halves. In addition to showing a fall arrest unit in an opened and exploded configuration, FIG. 18 also shows that the sub-assemblies can be used with different housing assemblies.

In view of the above, it will be seen that a retractable fall arrest unit is provided which can be easily disassembled in the field, to replace any of the four components of the fall arrest unit: the housing, the drum, the spring sub-assembly or the brake/clutch sub-assembly. The replaces components can be returned for service or repair. However, because the various components can be replaced in the field, there is very little down time for any particular unit. Hence, rather than having to stock one, two or more complete fall arrest units for each fall arrest unit in use, a site need only stock a supply of components.

As various changes could be made in the above constructions without departing from the scope of the invention, it is intended that all matter contained in the above description or shown in the accompanying drawings shall be interpreted as illustrative and not in a limiting sense. For example, although the shaft is preferably a two part shaft (comprised of the spring shaft and the brake/clutch shaft) the shaft could be a single one-piece shaft. The use of a one-piece shaft will work best when the two housing sides are held together with pins, rather than having a hinged connection, such that the two housing sides can be pulled apart from each other, rather than being pivoted relative to each other. Further, although the spring and brake/clutch sub-assemblies are secured to the housing by means of screws, the sub-assemblies could be secured by pins which are received in key-hole type slots in the unit housing. The sub-assemblies would be placed into the housing, and locked in place by twisting the sub-assembly relative to the housing. This twist-lock would allow for the sub-assemblies to be secured (and removed) without the use of tools. This example is merely illustrative.

The invention claimed is:

1. A retractable fall arrest device comprising:

a unit housing comprised of a first side member and a second side member; said first and second side members defining a chamber when assembled; said first and second side members being removably connectable; said unit housing defining an outlet;

a spring assembly comprising a spring housing; a spring shaft rotatably mounted in said spring housing and a spring member operably fixed to said spring shaft within said spring housing; said spring shaft extending from said spring housing; said spring assembly being removably mounted to said unit housing; said spring shaft extending into said chamber of said unit housing when said spring assembly is mounted to said unit housing;

a brake-clutch assembly comprising a brake-clutch housing, a brake-clutch shaft rotatably mounted in said brake-clutch housing, a clutch member operably fixed to said brake-clutch shaft within said brake-clutch housing to rotate within said brake-clutch housing, and a brake member mounted within said brake-clutch housing and operatively associated with said clutch member to slow or stop rotation of said clutch member upon activation of said brake member; said brake-clutch shaft extending from said brake-clutch housing; said brake-clutch assembly being removably mounted to said unit housing; said brake-clutch shaft extending into said chamber of said unit housing when said brake-clutch assembly is mounted to said unit housing; and a drum assembly received within said unit housing; said drum assembly comprising a central drum body, a spool portion, and a cable wound around said spool portion; said cable exiting said unit housing through said outlet of said unit housing;

wherein said spring shaft has an inner end and comprises a first drive member positioned at said inner end of said spring shaft; said brake-clutch shaft has an inner end and comprises a second drive member positioned at said inner end of said brake-clutch shaft; said first and second drive members removably connecting said shafts to said central drum body to positively engage said central drum body such that said drum assembly is rotatably mounted in said unit housing and such that said spring shaft, said brake-clutch shaft and said drum assembly are rotationally fixed relative to each other.

2. The retractable fall arrest device of claim 1 wherein one of said first and second drive members comprises a protrusion and the other of said first and second drive members comprises a complementary opening, the protrusion extending into and operatively engaging the opening such that preloading the spring member in said spring assembly applies a bias to the spring shaft that maintains engagement of said protrusion and said opening.

3. The retractable fall arrest device of claim 2 wherein said opening comprises a key hole slot having a head portion and an elongate leg portion, the elongate leg portion defining a slot having a width smaller than the head portion and a ledge; said protrusion comprising a head sized to pass through the head portion of said key hole slot and to engage the ledge of the elongate leg portion of said key hole slot.

4. The retractable fall arrest device of claim 1 wherein both of said first and second drive members respectively comprises a protrusion, the protrusions of each of said first and second drive members respectively being complementary to respective openings of the drum body; an opening of said openings and a respective complementary protrusion of said protrusions are tapered.

5. The retractable fall arrest device of claim 1 wherein said first and second members of said unit housing are pivotally connected together along an edge of said unit housing.

6. The retractable fall arrest device of claim 1 wherein said first and second side members of said unit housing are removably connected together by fasteners.

7. The retractable fall arrest device of claim 6 including a nozzle at said outlet of said unit housing; said outlet being spaced from a pivotal connection of said first and second side members of said unit housing; said fall arrest device including at least one fastener which removably extends through said unit housing first side member into said nozzle and at least one fastener which removably extends through said unit housing second side member into said nozzle.

8. The retractable fall arrest device of claim 1 wherein said spring assembly is a sealed assembly.

9. The retractable fall arrest device of claim 8 including an oil bath contained within said spring assembly housing; at least a portion of said spring member being in said oil bath when said spring assembly is generally vertically oriented.

10. The retractable fall device arrest of claim 1 wherein said brake-clutch assembly is a sealed assembly.

11. The retractable fall arrest device of claim 10 including an oil bath contained within said brake-clutch assembly housing; at least a portion of said clutch member and said brake member being in said oil bath when said brake-clutch assembly is generally vertically oriented.

12. The retractable fall arrest device of claim 1 wherein at least one of the first and second drive members of said shafts comprises at least one drive pin extending therefrom; said drum assembly comprising a hole sized and shaped complementarily to said at least one drive pin to receive said at least one drive pin.

13. The retractable fall arrest device of claim 12, wherein at least one of said first and second drive members is a drive hub rotationally fixed to one of said inner end of said spring shaft and said inner end of said brake-clutch shaft; said at least one drive pin extending from said drive hub.

14. The retractable fall arrest device of claim 1 wherein one of said first and second drive members comprises a drive plate attached to the inner end of its respective said spring shaft or said brake-clutch shaft, said drive plate comprising a protrusion positively connecting said drive plate to said drum assembly.

15. The retractable fall arrest device of claim 14 wherein said protrusion comprises at least one pin extending through said drive plate and said central drum body.

16. A retractable fall arrest device comprising:

a unit housing comprised of a first side member and a second side member; said first and second side members defining a chamber when assembled; said first and second side members being removably connectable; said unit housing defining an outlet;

a spring assembly comprising a spring housing; a spring member operably fixed to a spring shaft within said spring housing; said spring assembly being removably mounted to said unit housing; said spring shaft extending from said spring housing; said spring assembly being removably mounted to said unit housing; said spring shaft extending into said chamber of said unit housing when said spring assembly is mounted to said unit housing;

a brake-clutch assembly comprising a brake-clutch housing; a clutch member operably fixed to a brake-clutch shaft within said brake-clutch housing to rotate within said brake-clutch housing, and a brake member mounted within said brake-clutch housing and operatively associated with said clutch member to slow or stop rotation of said clutch member upon activation of said brake member; said brake-clutch shaft extending from said brake-clutch housing; said brake-clutch assembly being removably mounted to said unit housing; said brake-clutch shaft extending into said chamber of said unit housing when said brake-clutch assembly is mounted to said unit housing;

a drum assembly received within said unit housing; said drum assembly comprising a central drum body, a spool portion, and a cable wound around said spool portion; said cable exiting said unit housing through said outlet of said unit housing; and said spring shaft and said brake-clutch shaft each respectively extending at least in part into said unit housing and respectively being rotatable relative to said unit housing and said central drum body; said spring member being operatively fixed to said spring shaft within said spring housing to bias the shafts into detachable engagement with the drum body; said clutch member being operatively fixed to said brake-clutch shaft within said brake-clutch housing to rotate within said brake-clutch housing.

17. The retractable fall arrest device of claim 16 wherein said spring shaft and said brake-clutch shaft each comprises drive members at inner ends of said shafts; said drive members of said shafts being removably connectable to said central drum body to positively engage said central drum body such that said drum assembly is rotatably mounted in said unit housing and such that said spring shaft, said brake-clutch shaft and said drum assembly are rotationally fixed relative to each other.

* * * * *